United States Patent [19]

Harrison

[11] Patent Number: 4,661,689

[45] Date of Patent: Apr. 28, 1987

[54] ELECTRICAL HEATING PAD WITH ANTISTATIC SURFACE

[75] Inventor: John M. Harrison, Chattanooga, Tenn.

[73] Assignee: Collins & Aikman Corporation, New York, N.Y.

[21] Appl. No.: 791,787

[22] Filed: Oct. 28, 1985

[51] Int. Cl.[4] ..... H05B 3/34

[52] U.S. Cl. ..... 219/528; 219/549; 338/212

[58] Field of Search ..... 219/213, 345, 528, 549, 219/528; 338/212, 214; 361/216, 220

[56] References Cited

U.S. PATENT DOCUMENTS

| | | | |
|---|---|---|---|
| 798,043 | 7/1958 | Ford et al. . | |
| 2,302,003 | 11/1942 | Cadwell et al. | 361/212 X |
| 2,323,461 | 7/1943 | Donelson | 361/216 |
| 2,457,299 | 12/1948 | Biemesderfer, Jr. | 361/216 X |
| 2,851,639 | 9/1958 | Ford et al. | 361/216 |
| 3,121,825 | 2/1964 | Abegg et al. | 361/216 X |
| 3,371,247 | 2/1968 | Mallenger | 361/212 |
| 4,247,756 | 1/1981 | Cucinotta et al. | 219/549 X |
| 4,415,946 | 11/1983 | Pitts | 361/212 |
| 4,472,471 | 9/1984 | Klein et al. | 361/212 X |
| 4,485,297 | 11/1984 | Grise et al. | 219/528 |
| 4,491,894 | 1/1985 | Pitts | 361/212 |

*Primary Examiner*—L. T. Hix
*Assistant Examiner*—Douglas S. Lee
*Attorney, Agent, or Firm*—Bell, Seltzer, Park Gibson

[57] ABSTRACT

There is provided an electrical heating pad which includes an encapsulated electrical resistance heater. The upper surface of the pad is comprised of electrically conductive material for imparting antistatic properties to the upper surface of the pad.

4 Claims, 5 Drawing Figures

ELECTRICAL HEATING PAD WITH ANTISTATIC SURFACE

FIELD OF THE INVENTION

This invention relates to an electrical heating pad and, more particularly, to an electrical heating pad with an antistatic electricity surface.

BACKGROUND OF THE INVENTION

As the cost of energy has continued to rise steadily in significant proportions in recent years, the need for economic and efficient heating means has become great. This need has become particularly acute in commercial and industrial settings because of the specific problems encountered in those areas. In the commercial setting because of the frequent presence of computer related business equipment, it is often desirable to maintain the entire business or office environment at a cooler temperature than may be comfortable for most personnel. It is also desirable to avoid heating the entire environment in order to minimize energy consumption and expense. However, in office settings such efforts at energy savings have typically been counter-productive when sedentary personnel have required electrical space heaters for personal comfort. Such heaters while serving to supply heat to specific areas, consume substantial quantities of energy and present such hazards as overheating, fire and electrical shock.

Further problems are presented in industrial environments such as factories, mills and shops wherein the entire area of a facility to be heated may be so huge that maintaining the entire area at a temperature comfortable to personnel is virtually impossible and, in any event, economically unfeasible. Supplemental heat sources of various types have been used in industrial settings, such as electrical space and overhead radiation heaters, catalytic space heaters, forced air space heaters, and even open flame heaters. In the main, such heaters have proven to be unduly expensive to operate and maintain, inadequate at maintaining a comfortable temperature, and extremely hazardous in certain types of industrial workplace settings.

Another means of heating localized areas which has been proposed has been the use of floor mats or pads containing an electrical heat source to provide an indirect type of heat emanating from floor level for a particular area. Such pads have not been fully satisfactory either, however. Firstly, these pads have typically utilized a heating circuit including a length of resistance wire which, when energized with electrical current, generates heat. While this is a relatively simple type of heat source, it is one subject to being unreliable and unsafe. Fracture of the resistance wire can occur anywhere in the pad as a result of simple wear, or as the result of any number of causes such as from the spiked heel of a lady's shoe or from a falling tool. Such a fracture can serve to render the entire heating capability of the pad inoperative, and such a fracture can also result in deadly electrical shock or a short which can cause a fire or explosion. For these reasons, these pads have so far not been popular in commercial or industrial surroundings where they would likely be subjected to substantial foot traffic or where moisture or hostile chemicals could be expected to be encountered.

Although improvements have been made in heating pads such as by making the heat source less vulnerable to rupture and less a shock hazard, so far as applicant is aware prior to this invention, there still has been no electrical floor heating pad available for commercial or industrial uses that could satisfy Underwriters' Laboratories safety standards. Also, so far as applicant is aware prior to this invention, there has been no electrical heating pad available which eliminates static electricity build-up on the surface of same. In most offices and plants, the presence of static electricity can present substantial problems to personnel and equipment.

SUMMARY OF THE INVENTION

It is accordingly an object of the present invention to provide a safe and reliable arrangement for heating selected areas of an office or industrial facility by utilizing the heating pad which also has an antistatic surface. The heating pad is adapted to be placed on a floor and walked on and includes an encapsulated electrical resistance means serving as a heater for supplying heat to the pad. The upper surface of the body is formed of a plastic material having electrically conductive material present on the upper surface for imparting antistatic properties to the upper surface of the pad.

It is another object of the invention to provide an antistatic heating pad wherein said heating pad can comprise top and bottom layers and encapsulated electrical resistance means sandwiched therebetween and serving as a heater. The top layer can comprise a solid high impact, plastic body having a nonplanar upper surface so as to impart antislip properties thereto and the bottom layer can comprise a sheet of resilient foam material to provide a cushioning underfoot effect to the pad.

It is another object of the invention to provide an antistatic heating pad wherein an elongate electrical conductor can be electrically connected to said electrical resistance means and also electrically connected to the electrically conductive plastic material of said upper surface of said pad. The elongate conductor can provide a source of electrical power for said electrical resistance means and also provide means for conducting away static electricity present in the upper surface of the pad.

It is another object of the invention to provide an antistatic heating pad which can include an encapsulated and completely sealed electrical resistance means serving as a heater for supplying heat to the pad. The pad is layered and can include connected together top and bottom layers with the encapsulated and sealed electrical resistance means therebetween. The top layer can have antistatic properties and comprise a substantially moisture impervious high impact plastic material having electrically conductive material incorporated therein and the bottom layer can comprise a plastic foam material to cushion the pad and to insulate it from below and aid the radiation of heat upwardly.

It is another object of the invention to provide an antistatic heating pad which can include a pair of moisture impervious sheets with one sheet being positioned between encapsulated electrical resistance means and a top layer and a second sheet positioned on the opposite side of said encapulated resistance means between a bottom layer to further encapsulate said resistance means against moisture.

BRIEF DESCRIPTION OF THE DRAWINGS

Further and more specific features and advantages of the invention will become more apparant when taken in connection with the accompanying drawings, in which.

DETAILED DESCRIPTION OF THE ILLUSTRATED EMBODIMENT

While the present invention will be described more fully hereinafter with reference to the accompanying drawings, in which a particular form of carrying out the present invention is shown, it is to be understood at the outset of the description which follows that persons of skill in the appropriate arts may modify the form of the invention here described while still achieving the favorable results of this invention. Accordingly, the description which follows is to be understood as being a broad, teaching disclosure directed to persons of skill in the appropriate arts, and not as limiting upon the present invention.

Figure 1:
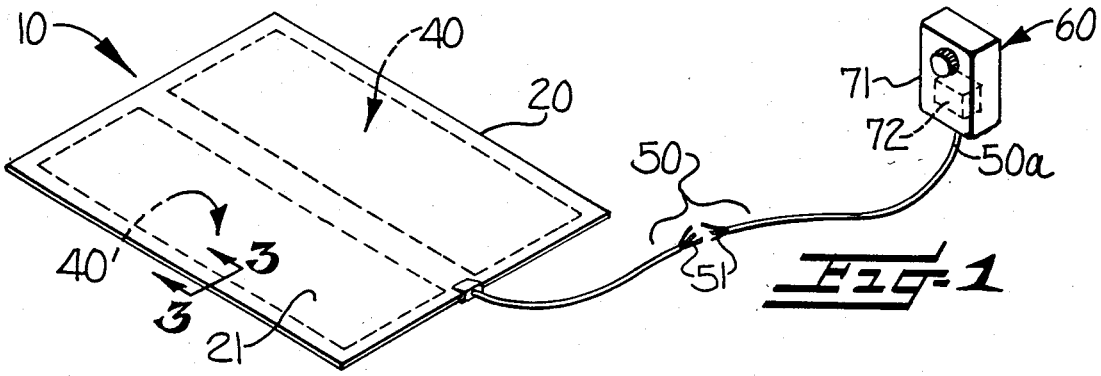
FIG. 1 is an environmental view generally illustrating the heating pad of the invention.
Figure 2:
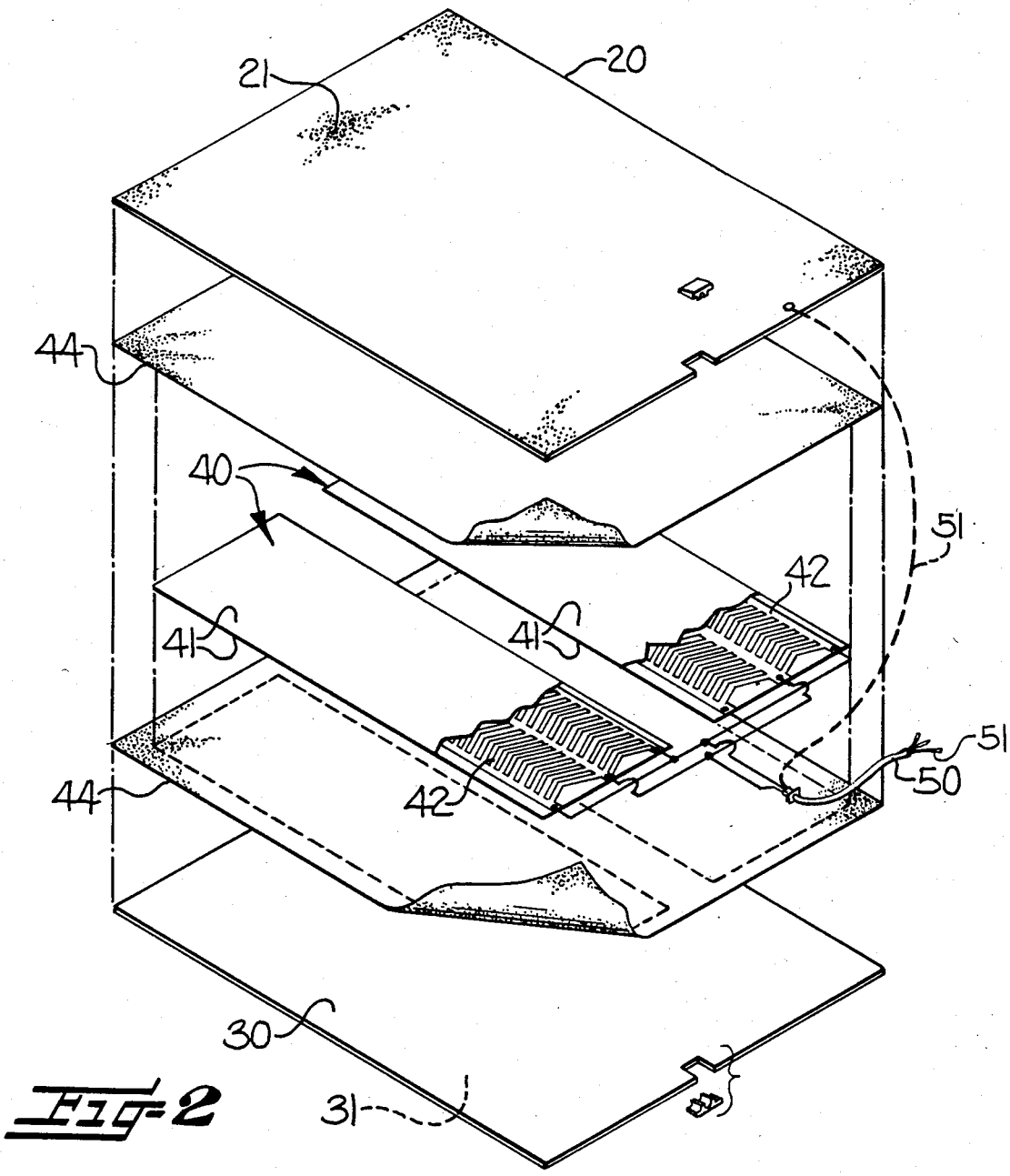
FIG. 2 is a perspective exploded view of the pad of the invention illustrating its component construction.
Figure 3:
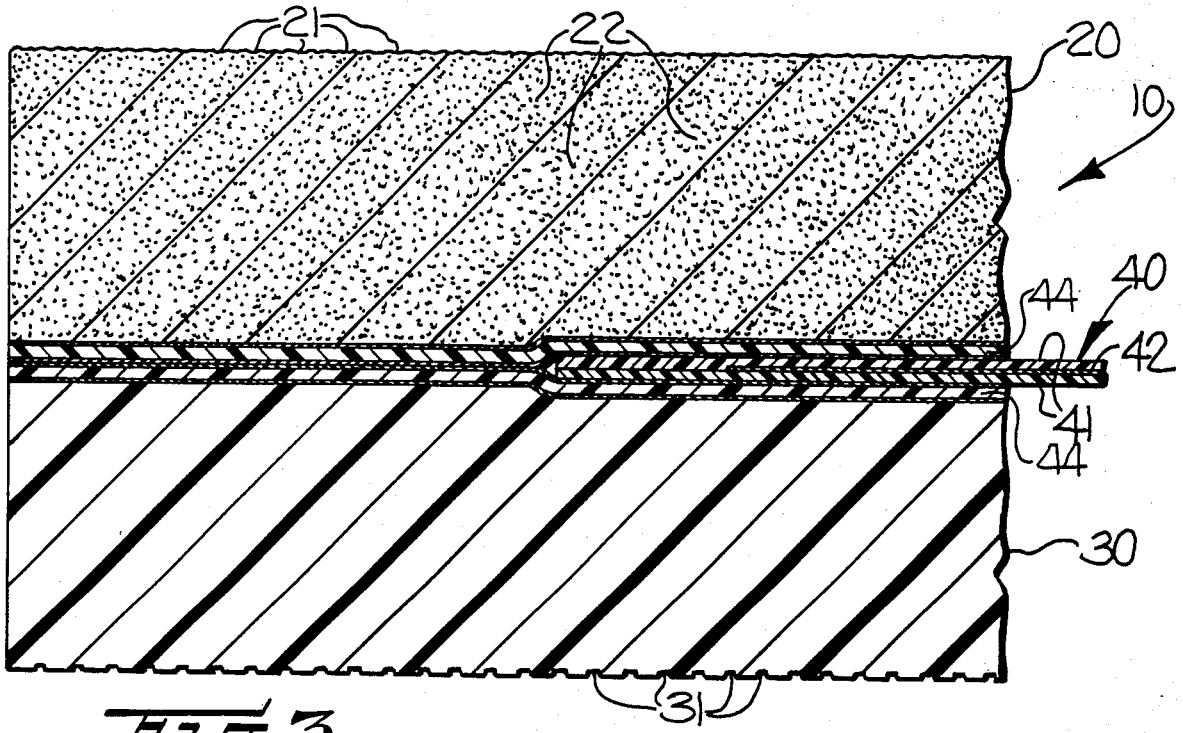
FIG. 3 is a vertical cross-sectional view of the heating pad of the invention taken along lines 3—3 of FIG. 1.

Referring now more specifically to the drawings, FIG. 1 illustrates an embodiment of the invention as illustrated in a typical commercial setting such as a business office and FIGS. 2 and 3 illustrate its component construction. As illustrated, the heating pad 10 of the invention is adapted to be placed on a floor and walked upon in the area being heated. Heating pad 10 is generally characterized in that it has underfoot resiliency and yet may not readily be damaged or mechanically penetrated as by the dropping or impacting of sharp instruments onto the pad. Heating pad 10 comprises top layer 20 and bottom layer 30, and encapsulated electrical means 40 sandwiched and provided therebetween serving as a heater for supplying heat to the pad 10.

Top layer 20 comprises a solid high impact, plastic body having a textured, nonplanar upper surface 21 so as to impart antislip properties thereto. Top layer 20 may specifically be formed of high impact ABS styrene or vinyl or other suitable sheeting of about $\frac{1}{8}$ inch in thickness which can adequately protect electrical resistance heater 40 from penetration or falling objects. When additional protection is desired such as in certain industrial applications, a thicker top layer may be used.

Electrically conductive or semi-conductive materials 22 such as carbonaceous compounds are desirably compounded into top layer 20 and present in the upper surface 21 thereof for imparting anti-static properties to the upper surface 21. It is important to include in the pad 10 of the invention such a means to eliminate the build-up of static electricity considering the environments for which pad 10 is intended for use. In addition to being annoying to personnel encountering minor shocks, the presence of static electricity presents particular problems to operations in office and industrial environments. For example, in offices containing computers and various types of data processing equipment, the presence of static electricity and stray currents can introduce undetectable errors in stored information or can even disable such equipment. And in industrial settings such as factories or laboratories, the presence of static electricity can be extremely detrimental to manufacturing operations or can even lead to devastating explosion if inflammable substances are present.

Bottom layer 30 comprises a sheet of resilient foam plastic material such as polyurethane, polyvinyl chloride, ethylene vinyl acetate, ethylene maleic anhydride or the like desirably at least about the same thickness, $\frac{1}{8}$ inch, as that of top layer 20. In industrial applications in which workers may be standing on pad 10 for extended periods of time it will be desirable to provide an even greater thickness of at least about $\frac{1}{4}$ inch to relieve worker fatigue. Bottom layer 30 desirably has a textured nonplanar bottom surface 31 to impart antislip properties thereto. The foam of bottom layer 30 is preferably closed celled with a "skinned" exterior surface so as to be substantially moisture impervious. Bottom layer 30 shields and heat insulates heater 40 from below and promotes the radiation of heat upwardly from said heater 40 while also serving as a resilient cushion. Bottom layer 30 thus aids the radiation of heat upwardly from the electrical resistance heater 40.

As shown particularly in FIG. 3 electrical resistance heater 40 desirably comprises a relatively thin plastic envelope formed by opposing thin sheets of plastic 41, one of said opposing plastic sheets having an electrical resistance circuit 42 printed on the inside face thereof, the other opposing plastic sheet being sealed to first sheet so as to form an encapsulated and completely sealed electrical resistance heater 40 therebetween. One heater 40 of this type is shown and illustrated in U.S. Pat. No. 4,485,297, assigned to Flexwatt Corporation. Alternatively (and not shown), a continuous layer of electrical resistance material could be included between these sheets. Each of opposing plastic sheets are on the order of only one mil in thickness or less so that the composite heater 40 is very thin, desirably less than 1/64 inch. This allows heating pad 10 to be relatively thin, less than about $\frac{1}{2}$ inch, so as not to create an impediment underfoot.

In pad 10 as illustrated in FIG. 2, a plurality of spaced apart heaters 40 are utilized and positioned between top and bottom layers, 20 and 30, and electrically connected together in parallel relation. Utilizing such an arrangement, acceptable heating may be maintained even if one unit should fail. Also, such parallel circuiting prevents the opening of one heater circuit from causing all heaters 40 to be inoperative. If desired, control of multiple heaters 40 may be stepped (one, two or three heaters on at a time) to control the amount of heat being generated.

Figure 4:
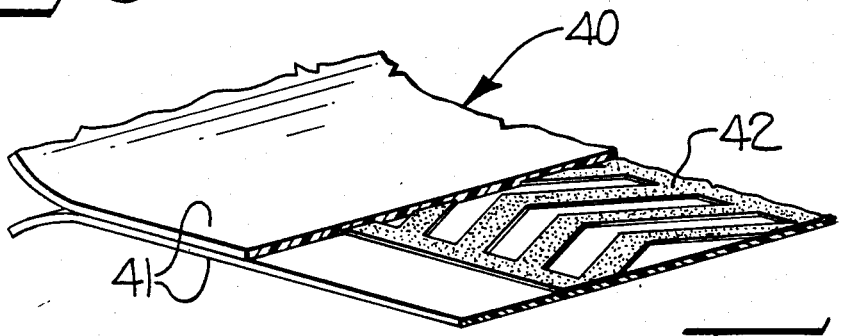
FIG. 4 is a partial perspective view of the electrical resistance heater of the pad of the invention broken away to illustrate its component construction.
Figure 5:
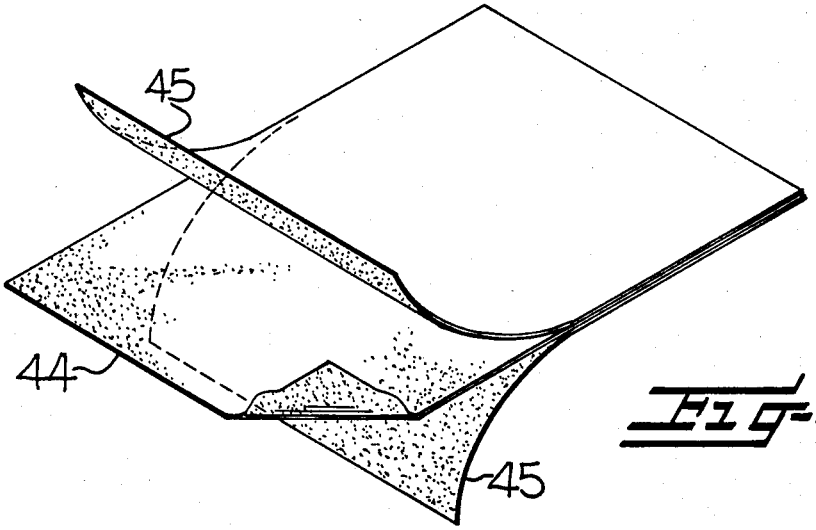
FIG. 5 is a partial perspective view of a double faced adhesive sheet utilized in the invention broken away to illustrate its component construction.

As shown in FIGS. 3,4 and 5, each heater 40 is desirably completely surrounded and sealed at its periphery by top and bottom layers, 20 and 30, to provide further protection from moisture and the environs for heaters 40 which are themselves sealed units. Desirably, top and bottom layers, 20 and 30, are bonded together completely where they contact one another and likewise where they contact heaters 40 to perfect this exterior seal around heaters 40. Such sealing and bonding may be accomplished by utilizing release paper carrier adhesive 43. This form of adhesive which is illustrated specifically in FIG. 5 comprises a relatively thin sheet (less than 1/32" thick) of adhesive material 44 with adhesive surfaces on opposite sides thereof with a layer of release paper 45 on each side for handling. Once the sheet is positioned the layers of release paper 45 are removed leaving the adhesive surfaces exposed for use. Here, desirably, one adhesive sheet 43 is positioned between said encapsulated electrical resistance means 40 and said top layer 20, and another adhesive sheet is positioned on the opposite side of said encapsulated resistance means 40 between said bottom layer 30 whereby said encapsulated electrical resistance means 40 is essentially further encapsulated against moisture. Use of such adhesive means guarantees uniform and complete adhesive coverage without gaps. A hot melt material or some other compatible and moisture resistant adhesive might otherwise be used so long as the resulting product would not delaminate at continuous operation in excess of 100° F.

An elongate electrical conductor line 50 is electrically connected to circuit 42, and said conductor 50 has inner end portions thereof desirably embedded in and bonded to the body of said heating pad 10 with the conductor 50 extending outwardly therefrom for connection to a suitable source of electrical power. As shown in FIG. 2 temperature control means 60 such as an adjustable rheostat is preferably included and electrically connected to the outer end 50*a* of said electrical conductor for selectively controlling the desired temperature of pad 10. An electrical conductor plug (not shown) is also electrically connected to the outer end 50*a* of electrical conductor 50 and desirably along with temperature control means 60 contained in a common housing 71 for compactness and protection of the internal components. Housing 71 may be formed of plastic, rubber or some other suitable durable electrical insulating material. Conductor line 50 also desirably includes an electrically conductive grounding line 51 electrically connected to the electrically conductive plastic material upper surface of top layer 20 and serves as means for conducting away static electricity present in the upper surface of said pad 10. Grounding line 51 includes electrical resistance means desirably located within housing 71 to dissipate and eliminate the static charge conducted therethrough.

For added safety against electrical shock hazard there may be provided a ground fault circuit interrupter relay 72 connected to the outer end 50*a* of said electrical conductor to interrupt the electrical current supply if a shorting condition occurs, such as a shorting out of heater 40. This relay likewise may be desirably contained in and protected by housing 71. In lieu of this relay 72, there alternatively can be provided other means connected to electrical conductor 50 for preventing electrical shock from a shorting condition such as a layer of electrical grounding material (not shown) adjacent the heater 40. As a further safety feature, as shown in FIG. 2, there may be included within pad 10 and adjacent heaters 40, devices which serve as means for preventing overheating of the heaters 40. These overheat devices (not shown) may be thermistors, thermostats or the like, which act to interrupt the current to the heaters if a predetermined temperature is exceeded, such as through failure of temperature control means 60, thereby avoiding excessive heat and the hazard of fire.

As shown in FIG. 2 heating pad 10 desirably includes a plurality of heaters 40 between upper layer 20 and bottom layer 30 placed therein at predetermined locations to provide heat in particular desired areas across pad 10. The particular arrangement shown in FIG. 2 should result in heat being provided generally uniformly across the pad 10.

Contrary to what might be expected, overlying heater 40 with a relatively thick high impact upper layer 20 does not render the pad 10 ineffective insofar as heating qualities are concerned but rather yields a pad in which heat is generated in an even and comfortable manner.

The heating pad of the invention is thus fully portable and serves as a safe means of providing primary or supplemental heat to a particular area while also serving to protect the carpet or floor underneath and eliminating the build-up of undesired static electricity. Thus while the primary and central heating system of an office or factory might maintain a continuing temperature of 50° F. to 60° F. throughout, pads of the invention can be used in those particular areas being occupied by personnel to provide supplemental heat as needed. Or, if desired, multiple pads of the invention could be used to maintain a constant background temperature level and conventional space heaters could be used in local areas intermittently to produce additional heat when and where it is needed.

Furthermore, the structure and features of the invention provide a heater which is uniquely safe. For example, the current conducting portion of the heater 40 is doubly protected and sealed to prevent shock hazard even if the surrounding area is flooded by liquid. Also, containing the temperature control box and electrical supply in a common housing apart from the pad 10 protects these relatively vulnerable components from possible damage.

Testing

The desired embodiment is intended to perform satisfactorily when subjected to a variety of operational tests. In such tests a sample is laid on a floor of a 90° alcove consisting of two vertical walls of ⅜" black painted plywood supported by vertical studs (nominal 2×4) on 16 inch centers. The floor shall be ¾" plywood. The heater shall be located as close to the sides of the wall angle as its construction shall permit. All tests discussed below are conducted in this test environment construction.

Continuous Operation Tests

1. Power Input: The power input shall not be more than 105% nor less than 90% of the given rating while connected to a supply circuit of rated voltage.

2. Normal Temperature Tests: Maximum allowable temperature for materials and support surfaces is 90° C. based on a 25° C. ambient. Temperatures are to be measured by No. 30 AWG Type J thermocouples and a potentiometer-type instrument. The heater is to be operated continuously until constant temperatures have been reached. The test voltage is to be highest marked voltage or, if the measured wattage is not equal or more than the marked wattage rating, the test voltage is to be increased until the measured wattage input equals the marked wattage rating.

3. Dielectric Withstand Test: After the sample has been operated for a period of time so as to be in a heated condition, an AC potential is applied between current-carrying parts and dead-metal parts. For this test, a dead-metal part is a single sheet of aluminum foil placed in close contact with the exposed top surface of the sample. Starting at zero, the potential is gradually increased to 1000 V and maintained at this value for a period of one minute without insulation breakdown.

a. Repeated with foil in close contact with both top and bottom surfaces.

b. Repeated using antistatic surface as dead-metal part.

4. Leakage Current Test: The sample is placed on an insulating surface and a 1500 ohm resistor, shunted by a 0.15 uf capacitor connected between dead-metal parts, simulated by a single sheet of aluminum foil placed in close contact with the top surface of the sample, and the neutral conductor with readings recorded. A suitable meter is used to measure the voltage drop across the resistor under the following conditions:

a. Unenergized line conductor open, neutral conductor closed.

b. Same as a. with attachment plug reversed.

c. Sample operated in the intended manner with periodic readings taken as the leakage current reaches equilibrium. Each reading is taken with the plug inserted in both possible positions and the maximum value recorded.

Abnormal Operation Tests

1. Static Load Test: On a sample, a simulated four legged stool with flat bottom legs, each approximately $\frac{7}{8}''$ diameter placed with all four legs directly over one or more of the heated areas of the element, is to be loaded with 600 pounds of weight. After 15 days the following tests are conducted:

a. Sample is energized to determine if it will operate as intended.

b. Dielectric withstand test described above.

c. Inspection of sample to determine the effect of the prolonged static load.

2. Dynamic Load Test: On a sample, a metal caster, having diameter of approximately two inches and a width of approximately one inch arranged to apply a load of 150 pounds on the covering, is to be driven back and forth over 12 inches of travel above one section of heated area. After 6000 cycles the following tests are conducted:

a. Sample energized to see if it will function as intended.

b. Dielectric withstand test described above.

c. Visual inspection of the sample to determine any adverse effects.

3. Immersion Tests: A sample is immersed in tap water for a period of four hours after which the following tests are conducted:

a. Energized operation for two hours without hot spots and/or adverse conditions.

b. Dielectric withstand test described above.

Following the test after immersion in the tap water the sample is immersed in a saline solution of eight grams of table salt per liter of tap water for a period of four hours after which the following tests are conducted:

a. Energized operation for two hours without hot spots and/or adverse conditions.

b. Dielectric withstand test described above.

4. Abuse Test: A flat iron weighing approximately four pounds is dropped on an energized sample installation 10 times with the point down from a height of three feet in such a manner as to land in the same six inch square of the sample. Then the installation is deenergized and subjected to a dielectric withstand test.

5. Over-voltage Test: On a sample, a one inch thick hair felt pad is placed over the entire surface with any seams in the hair felt pad overlapping by two inches. The system is energized and operated at 125% of the watt density per square foot of heated areas as determined from the continuous operation test, for seven hours (equivalent to 112.5% over-voltage). Failure mode occurs if there is ignition, emission of smoke, or excessive deterioration.

6. Puncture Test: For industrial application the heater may be required to meet a puncture test wherein the top surface material of a sample is penetrated with metal carpet tacks of sufficient lengths to pierce through the surface into the heating element so that there is continuity between heating element and the metal tacks. This is repeated 25 times after which the tacks are removed and the following tests are conducted:

a. Sample is energized for two hours to see if it will operate as intended.

b. Dielectric withstand test.

c. Visually inspect components of the system to determine any adverse conditions.

In the drawings and specification, there has been disclosed typical preferred embodiments of the invention and although specific terms are employed, they are used in a generic and descriptive sense only and not for purposes of limitation.

That which is claimed is:

1. An electrical heating pad of the type adapted to be placed on a floor and walked upon, said pad including an encapsulated electrical resistance means serving as a heater for supplying heat to the pad, and wherein the upper surface of said pad is formed of a solid high impact plastic material having electrically conductive material present on the upper surface thereof for imparting antistatic properties to the upper surface of the pad, and an elongate electrical conductor electrically connected to said electrical resistance means and also electrically connected to the electrically conductive upper surface of the plastic material for providing a source of electrical power for said electrical resistance means and for also providing means for conducting away any static electricity present in the upper surface of said pad.

2. An electrical heating pad comprising top and bottom layers and an encapsulated electrical resistance means sandwiched therebetween and serving as a heater, said top layer comprising a solid high impact, plastic body having electrically conductive material present on the upper surface thereof for imparting antistatic properties to the upper surface of the pad, said plastic body also having a nonplanar upper surface so as to impart antislip properties thereto for added safety underfoot, said bottom layer comprising a sheet of resilient foam material providing a cushioned underfoot effect to the pad, and an elongate electrical conductor electrically connected to said electrical resistance means and also electrically connected to the electrically conductive upper surface of the plastic material for providing a source of electrical power for said electrical resistance means and for also providing means for conducting away any static electricity present in the upper surface of said pad.

3. An electrical heating pad of the type adapted to be placed on a floor and walked upon, said pad including an encapsulated and completely sealed electrical resistance means provided therein and serving as a heater for supplying heat to the pad, said pad being layered and including connected together top and bottom layers with said encapsulated and sealed electrical resistance means therebetween, said top layer having antistatic properties and comprising a substantially moisture impervious solid high impact plastic material having electrically conductive material incorporated therein for imparting antistatic properties to the upper surface of the pad, an elongate electrical conductor electrically connected to said electrical resistance means and also electrically connected to the electrically conductive upper surface of the plastic material for providing a source of electrical power for said electrical resistance means and for also providing means for conducting away any static electricity present in the upper surface of said pad, and wherein said bottom layer comprises a plastic foam material to cushion the pad and to insulate the pad from below and aid the radiation of heat upwardly from said electrical resistance heater.

4. A heating pad according to claim 2 or 3 including a pair of moisture impervious sheets having adhesive on opposite sides thereof, one of said sheets being positioned between said encapsulated electrical resistance means and said top layer and the other sheet being positioned on the opposite side of said encapsulated electrical resistance means between said bottom layer whereby said encapsulated electrical resistance means is essentially further encapsulated against moisture.

* * * * *